United States Patent [19]

Kelly et al.

[11] Patent Number: 4,619,365

[45] Date of Patent: Oct. 28, 1986

[54] BOX AND FASTENER FOR STACKING

[75] Inventors: Dean A. Kelly, Angola; Strother H. Brann, Indianapolis, both of Ind.

[73] Assignee: Alca Enterprises, Inc., Ashley, Ind.

[21] Appl. No.: 678,655

[22] Filed: Dec. 6, 1984

[51] Int. Cl.[4] ..... B65D 21/02; B65D 6/24

[52] U.S. Cl. ..... 206/503; 206/504; 206/509; 206/821; 229/49; 229/915; 229/918

[58] Field of Search ..... 206/821, 503, 504, 509; 229/49, DIG. 11

[56] References Cited

U.S. PATENT DOCUMENTS

| | | | |
|---|---|---|---|
| D. 251,102 | 2/1979 | Box | D7/19 |
| 2,107,023 | 1/1938 | Bertsch | 220/23.8 |
| 3,381,876 | 5/1968 | Biggins | D7/38 |
| 3,878,980 | 4/1975 | Crane | 229/DIG. 11 |
| 4,039,121 | 8/1977 | Crane | 229/DIG. 11 |
| 4,126,265 | 11/1978 | Holmes | 206/821 |
| 4,449,662 | 5/1984 | Okamura et al. | 229/49 |
| 4,461,396 | 7/1984 | Harper | 220/23.8 |

FOREIGN PATENT DOCUMENTS

| | | | |
|---|---|---|---|
| 2804406 | 8/1979 | Fed. Rep. of Germany | 229/DIG. 11 |
| 2449618 | 10/1980 | France | 229/DIG. 11 |
| 7806424 | 12/1979 | Netherlands | 229/DIG. 11 |
| 255643 | 7/1926 | United Kingdom | 220/23.8 |
| 266528 | 3/1927 | United Kingdom | 220/23.8 |
| 280300 | 11/1927 | United Kingdom | D7/38 |
| 2078095 | 1/1982 | United Kingdom | D7/38 |
| 2078493 | 1/1982 | United Kingdom | 220/23.83 |

*Primary Examiner*—George E. Lowrance

*Attorney, Agent, or Firm*—Pearne, Gordon, Sessions, McCoy, Granger, & Tilberry

[57] ABSTRACT

Open-faced cartons of the corrugated paper type and corner holders therefor having stacking lugs for cooperating with the apertured bottom of another like carton to preclude lateral movement between a pair of cartons when one is stacked on the other are disclosed. In one preferred form, each corner holder comprises inner and outer sidewall engaging flanges interconnected by a "U" shaped portion to be disposed in a carton sidewall slot with a lug in the form of a relatively flat blade and a pair of reinforcing gussets extending upwardly into the bottom of a superadjacent tray. Two such carton sidewall slot engaging clasps interconnected by a generally flat rib may be employed at each corner around an open carton face to hold the carton material in its folded position, provide a support surface for a superadjacent tray and to prevent lateral movement of that superadjacent tray on the support surface. Column joining tie sheets especially suited to use with such cartons and corner holders are also disclosed.

7 Claims, 7 Drawing Figures

BOX AND FASTENER FOR STACKING

BRIEF SUMMARY OF THE INVENTION

The present invention relates generally to cartons or trays formed of foldable sheet material and more particularly to such trays of a corrugated paper having removable corner fasteners.

There are a wide variety of containers, such as open-face trays or other similar boxes, fabricated by folding relatively flat corrugated blanks, such as corrugated paper or other foldable sheet material, and then selectively fastening certain portions of that sheet material together to form the desired box configuration. Frequently a simple gluing process is employed, but with such adhesive techniques, the box once formed cannot readily be collapsed back into a flat configuration for storage or shipment and subsequent use. A number of clever techniques for folding and interlocking the foldable material to allow for subsequent collapse and then reuse of the box have also been devised. U.S. Pat. No. 4,449,662 illustrates one such collapsible box.

The folding techniques disclosed in U.S. Pat. No. 4,449,662 are comparatively simple, however, the box itself is not self locking, but rather employs four corner holders of plastic material disposed in pairs of slots closely adjacent each of the four corners. These corner holders have inner and outer flanges for engaging inner and outer box sidewall portions and a "U" shaped shank portion interconnecting respective inner and outer flanges and positionable in a slot so as to clamp together two separate sidewall forming layers without the need of glue or other adhesive material and, of course, allowing for removal of the corner holders and the nondestructive collapsing of the box. Each corner holder is formed from two generally similar sidewall gripping clasps with a flexible strip interconnecting that pair of clasps and forming with the clasps an upper support surface for receiving a like box in stacked relationship. Two possible stacking modes are suggested in the patent. In one form the upper supporting edge of the flexible member interconnecting pairs of clamps at the respective corners is coplanar with the upper surface of the box and with the upper surfaces of the clamps themselves, thus leading to a stacking relationship with one box supported on the upper surface of the next subadjacent box in a rather conventional manner. The patentee further recognizes the desirability of limiting relative lateral movement between boxes in a stacked relationship and achieves this in a second mode by lowering the support surface of the clasp interconnecting member and tapering the box sidewalls so that the bottom of the box is of somewhat smaller dimension than the top of the box and one box can slip down into another for stacking purposes. Such an approach, of course, reduces the useful capacity of the box, both in the vertical direction and in the horizontal dimensions as well as sacrificing vertical sidewall support strength. These reductions contribute to an overall diminution of product carrying capacity for the box and limit the height to which a column of such boxes can be stacked.

Among the several objects of the present invention may be noted a generalized improvement in corner holders for collapsible boxes; the provision of a lateral interlock arrangement for stacked boxes not reducing the product carrying capacity of the boxes; the provision of improvements in open-faced trays formed by selectively folding a blank which facilitates the vertical stacking of those trays; an overall improvement in the vertical strength and lateral stability of a column of stacked containers; and the provision of selectively interlockable lugs and apertures for boxes to limit lateral movement among several such boxes stacked in a vertical column. These and other objects and advantageous features of the present invention will be in part apparent and in part pointed out hereinafter.

In general and in one form of the invention, an open-faced tray has a generally flat bottom and four upstanding sidewalls with a plurality of elongated stacking lug receiving slots in the bottom near respective sidewalls elongated in a direction parallel to those respective sidewalls and pairwise closely adjacent near respective corners of the tray extending generally perpendicular to one another.

Also in general and in one form of the invention, a corner reinforcing member to be used in conjunction with a box such as a tray formed of corrugated paper has a lug protruding upwardly for engaging and limiting lateral movement of a superadjacent like box.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
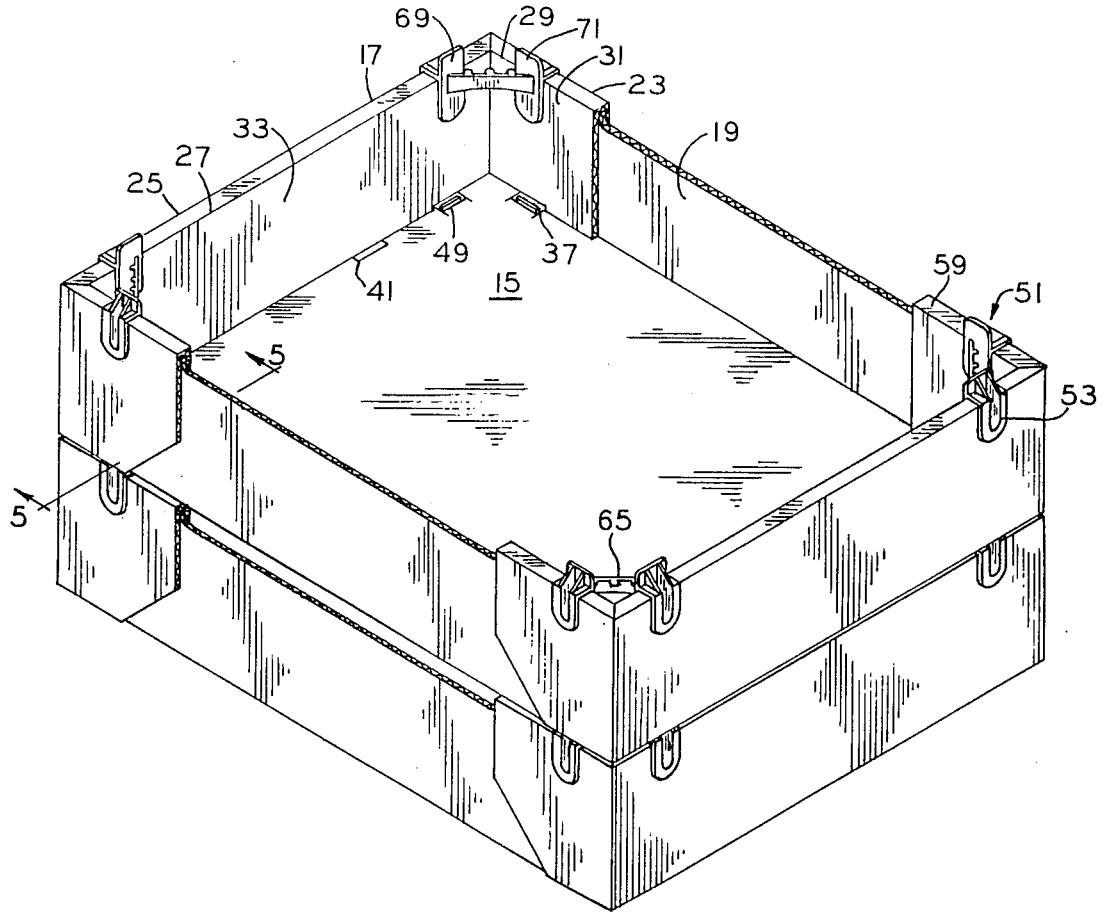
FIG. 1 is a perspective view of a stacked pair of like boxes incorporating one form of the invention.
Figure 4:
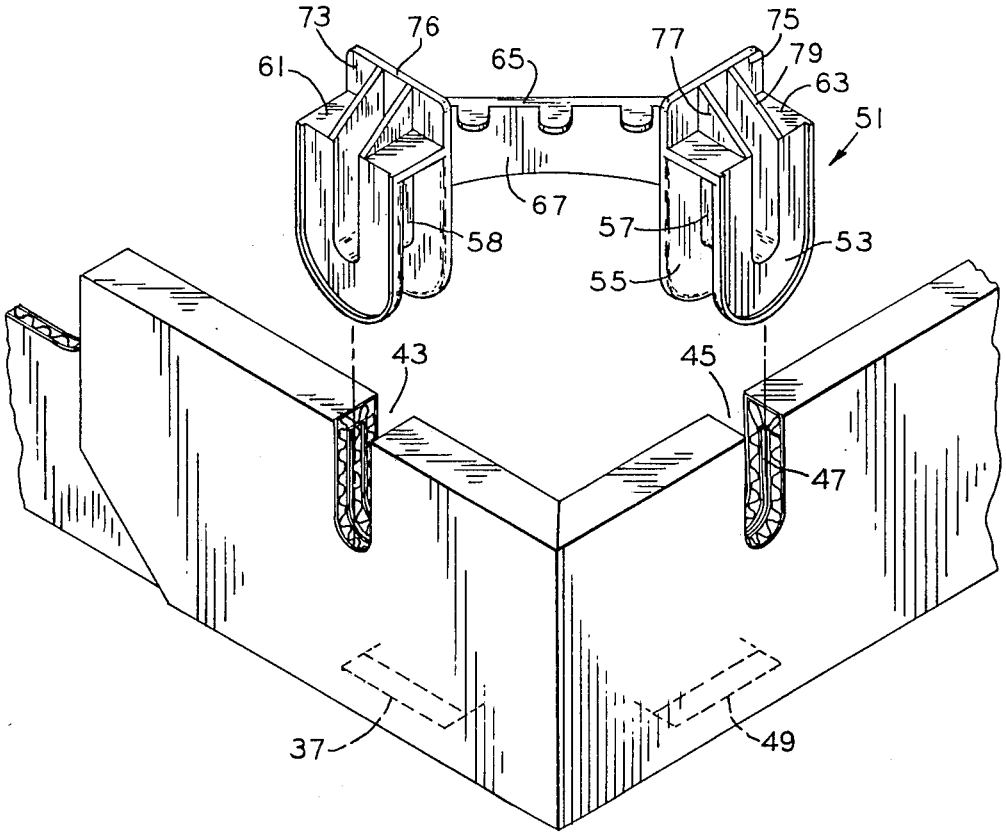
FIG. 4 is an exploded perspective view illustrating a corner portion of a box of FIG. 1 with the corner reinforcing stacking member separated therefrom.
Figure 6:
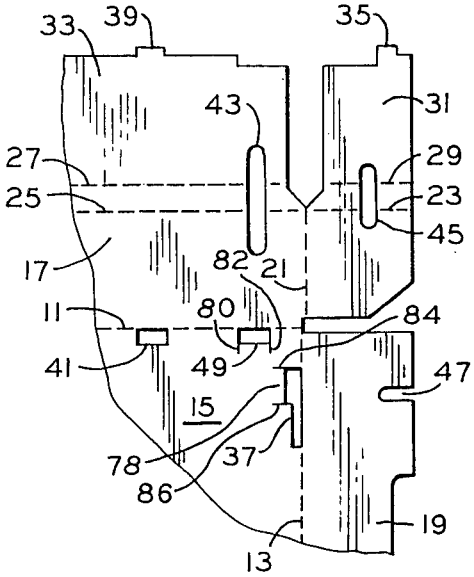
FIG. 6 is a partial view of a corner of a flat corrugated paper blank foldable to form an open-faced tray in accordance with the present invention.

FIG. 1 illustrates a pair of boxes of the open-faced tray type superposed in a stacked vertical relationship in accordance with the techniques of the present invention. The initial fabrication of these boxes begins with a foldable sheet material, such as corrugated paper, one corner of which is illustrated in FIG. 6 with the other three corners being successive mirror reflections of the configuration illustrated. In forming the box, sidewall portions are created by imparting substantially ninety (90) degree bends to the blank along the lines 11 and 13 upwardly or out of the paper as viewed in FIG. 6, thus initially forming bottom 15 and sidewall portions 17 and 19. Further right angle bends are imparted along lines 21, 23 and 25 and thereafter still further right angle bends are imparted along the lines 27 and 29, so that inner sidewall flaps 31 and 33 are tucked back inside the box with projection 35 extending into a portion of elongated slot 37 while projection 39 rests in elongated slot 41. Structure results by applying adhesive to form a permanent box. Still referring to FIG. 6, the elongated slot 43, when folds 25 and 27 are completed, opens upwardly as illustrated in FIG. 4 and similarly elongated slot 45 is folded over open ended slot 47 to again provide an upwardly opening slot as depicted in FIG. 4. The four slots 49 and the four portions of slots 37 not occupied by the tabs 35 are for receiving eight upwardly projecting locking lugs of a subadjacent box as will appear more clearly subsequently.

Referring now primarily to FIG. 4, the corner reinforcing stacking member 51 may, for example, be molded of any suitable plastic material and is in essence a pair of clamps to be slid into slots 43 and 45, 47 respectively to clamp together the several layers of the carton sidewalls. Each clamp comprises an outer flange 53 and an inner flange 55 which are adapted to lie closely adjacent respective inner and outer sidewall surfaces with those two flanges being interconnected by a shank 57 of a length sufficient to span the distance between the inner and outer wall surfaces. As illustrated the shank 57 is of a generally "U" shaped configuration. In FIG. 4 "U" shaped shank 57 is of the same length as the "U" shaped portion 58 associated with the other clasp of the pair, however, for the particular open-faced carton described, one of these shanks spans three layers of corrugated paper, while the other spans only two. Shank length variations are, of course, possible, however, due to the compressibility of the corrugated sheet material equal shank lengths do not create a problem and eliminate the need for two different type corner holders.

Comparing FIGS. 1 and 4, when the corner holder is seated with the respective "U" shaped shanks in their respective notches, the upper edge 59 of the open-face carton, the upper surfaces, such as 61 and 63 of the corner holding clamps and the upper supporting edge 65 of the generally flat vertically disposed rib 67 which extends linearly between clasp pairs at about forty-five (45) degrees to the sidewalls are all substantially coplanar and form a surface for receiving a superadjacent box in stacked relationship. To prevent lateral movement between adjacent boxes or cartons in such a stacked relationship, the corner holders further include upstanding lugs, such as 69 and 71, which pass into the elongated apertures, such as 37 and 49, thus securely laterally fixing the relative carton positions. Each of these upstanding lugs, such as 69 or 71, is formed as a generally flat upstanding blade 73 or 75 which is merely a vertical extension of the inner flange 55 and has an outwardly facing surface adapted to abut an inside surface of the sidewall flap 33 which comprises a vertical wall. A blade such as 75 is comparatively fragile, but is rigidly reinforced by a pair of triangular gussets 77 and 79 extending normal to the blade and themselves being upward extensions of opposite sidewall portions of the "U" shaped shank 57.

Figure 2:
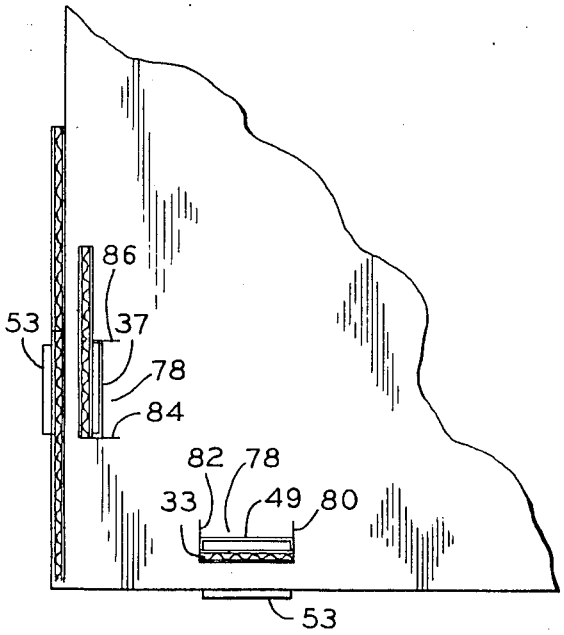
FIG. 2 is a partial plan view of the bottom of one of the boxes of FIG. 1.
Figure 3:
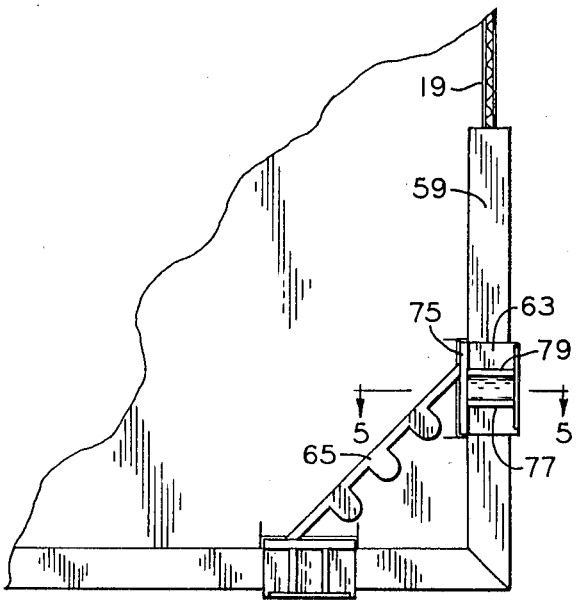
FIG. 3 is a top plan view of a corner portion of one of boxes of FIG. 1.
Figure 5:
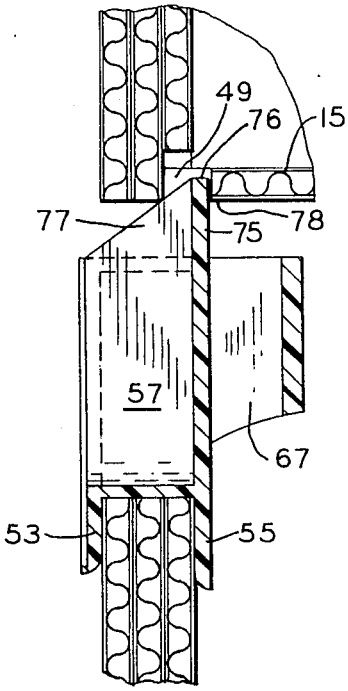
FIG. 5 is a partial cross sectional view generally along line 5—5 of FIGS. 1 and 3, and illustrating a second superadjacent box portion aligned therewith.

FIG. 5 illustrates a slot 49 in the bottom 15 of a superadjacent carton being engaged with an upstanding lug of a next lower carton when stacking one carton on the other. As the upper carton settles into position, some slight deformation of the outer corrugated paper wall of the upper carton may occur due to the triangular gusset 77 engaging that wall portion and the upper carton will settle into position resting on surfaces 59, 61, 63 and the upper support edge 65 of generally flat rib 67 thereby providing good support for each carton in the stack with the lugs virtually precluding lateral movement of any one of the cartons relative to the next lower carton. During a stacking process there may be a slight misalignment between superposed boxes and sometimes upper surface 76 of a lug may engage and tend to hang up on the lower surface of a superadajacent tray in the region indicated generally by reference numeral 78 in FIGS. 2, 5 and 6. To prevent such hang up during stacking of the boxes, the carton bottom 15 is further lanced or provided with slits, such as 80, 82, 84 and 86 of FIGS. 2 and 6. These slits allow the bottom to yield somewhat during the stacking operation ensuring that the superadjacent carton settles into its proper position on the next subadjacent carton.

In use the corner reinforced trays as thus far discussed may be filled with a product to be shipped and a number of such filled trays stacked in a column and several such columns bundled together, frequently atop a pallet for facilitating movement by a forklift truck to and from a railway car or trailer for shipment to the product destination. Six columns of boxes or trays each about six feet in height has been found to be a convenient bundle configuration, though, of course, other configurations are possible. During loading, unloading and shipment, the product containing tray columns are subjected to numerous forces as, for example, when a truck containing the bundles turns a sharp corner or stops abruptly. Of course, the greater the column height, the more probable it is that a column may topple when subjected to such forces. On the other hand, tray columns must be stacked to a reasonable height to achieve a resonably full load for shipment. Various packaging techniques including banding and webbing of bundles, sometimes including so-called tie sheets, horizontally spanning the entire bundle and at vertical intervals have been proposed. The unique carton and corner holder arrangement of the present invention facilitates columnar interlocking by tie sheets and, in fact, achieves stability comparable to prior art techniques using only one half to one quarter the number of such tie sheets.

Figure 7:
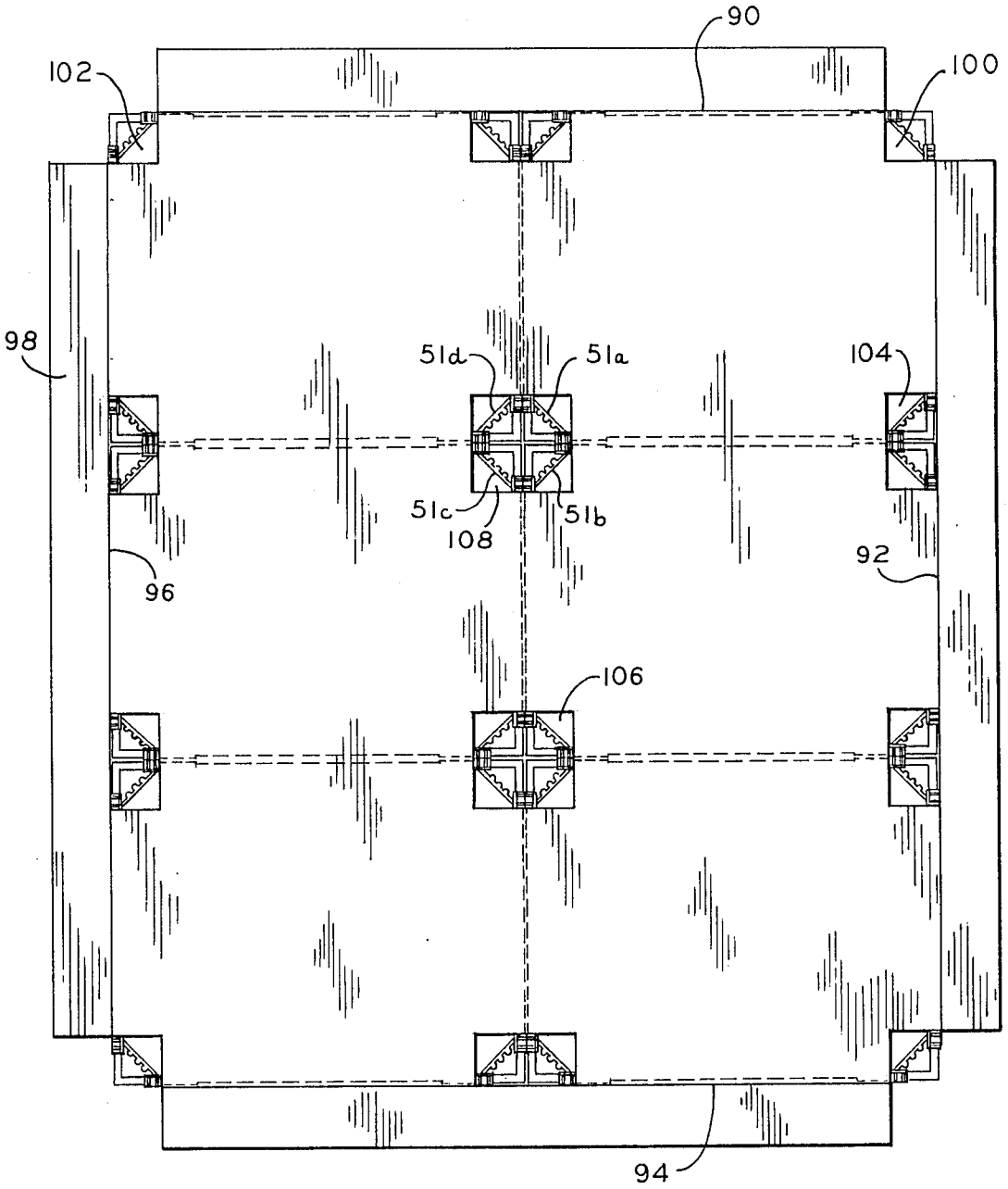
FIG. 7 is a plan view of a tie sheet useful in packaging a bundle of tray columns.

FIG. 7 illustrates the top of a tie sheet overlying six tray columns. The tie sheet may be formed of a corrugated paper and may be folded through a ninety (90) degree bend along the lines 90, 92, 94 and 96 to provide for downwardly depending outer flaps, such as 98. The tie sheet of FIG. 7 is also cut away at the extreme corners, such as 100 and 102 to receive the outer corner locking lugs of four (4) of the uppermost trays. The tie sheet is similarly apertured as by a square hole 104 which hole receives the four lugs associated with two (2) further corner holders. A pair of generally centrally located rectangular openings 106 and 108 are provided to receive the upstanding lugs of four adjacent corner holders, such as 51*a*, 51*b*, 51*c* and 51*d*. Thus, the tie sheet of FIG. 7 is appropriately apertured to receive whatever upstanding lugs may be associated with the uppermost layer of trays, thereby functioning to hold the several columns of trays closely adjacent one another. For an approximately six foot column, prior carton stacking techniques required four such tie sheets whereas experimentation with the present arrangement has indicated that two such tie sheets are quite adequate and that one such tie sheet uppermost in the columnar bundle may be sufficient.

From the foregoing it is now apparent that a novel box of foldable sheet material, such as corrugated paper, as well as a novel corner holder in the form of a reinforcing stacking member for use in conjunction with such boxes has been disclosed meeting the objects and advantageous features set out hereinbefore as well as others and that modifications as to the precise configuration, shapes and details may be made by those having ordinary skill in the art without departing from the spirit of the invention or the scope thereof as set out by the claims which follow.

What is claimed is:

1. In an open-faced tray of generally rectangular configuration formed by selectively folding a flat corrugated paper blank and having, when selectively folded, a bottom portion and vertical walls with corner holders near the open face, the improvement wherein the corner holders each comprise inner and outer flanges lying closely adjacent corresponding inner and outer tray sidewall portions and connected by an intermediate portion disposed in a tray sidewall slot and having a "U" shape in the plane of the sidewall, each corner holder including a plurality of relatively rigid upstanding lugs each having a relatively flat upstanding blade extending upwardly, as an extension of the inner flange, beyond the tray open face, each corner holder including reinforcing gussets extending generally normal to said blade flat surface, the gussets being formed as upward extensions of the opposte "U" portion sides, and a cooperating plurality of openings in a tray surface bottom wall opposite the open face whereby a number of such trays may be stacked one upon the other with adjacent trays in the stack having the lugs of one received in the openings of the other with a flat surface of each said flat upstanding blades being adapted to abut an inside surface of a vertical wall of the superjacent tray to substantially limit lateral movement between the trays.

2. The improvement of claim 1 wherein said corner holders are joined in pairs by a vertically disposed generally flat rib extending linearly therebetween and having an upper edge for supporting the superjacent tray.

3. The improvement of claim 2 wherein the rib upper edge lies in a plane separating the "U" shaped portions from the corresponding lugs.

4. The improvement of claim: 3 wherein the rib forms an angle of about forty-five (45) degrees with each of two adjacent tray sidewalls.

5. The improvement of claim 1 further comprising a sheet having a plurality of apertures for receiving the upstanding lugs fixing the relative position of the tray and sheet, and a further plurality of apertures in the sheet for receiving lugs of like adjacent trays to thereby laterally tie the adjacent trays together.

6. A corner reinforcing stacking member for use in conjunction with a box of foldable sheet material such as corrugated paper comprising inner and outer flanges adapted to lie closely adjacent corresponding inner and outer surfaces of a box sidewall portion, a shank intermediate said flanges having a "U" shape in a plane corresponding to the plane of a box sidewall portion and a length sufficient to span multiple layers of sheet material between the inner and outer surfaces of the box sidewall portions, means defining a generally planar surface for receiving and supporting a superjacent like box in stacked relationship, and a lug extending from the planar surface in a direction opposite the flanges and shank for engaging and limiting lateral movement of a superjacent like box, said lug comprising a relatively flat upstanding blade formed as an extension of the inner flange and a pair of reinforcing gussets extending generally normal to the flat blade, the gussets being formed as upward extensions of opposite sides of the "U" shaped shank.

7. The member of claim 6 wherein the lug extends beyond the planar surface a distance sufficient to pass through an aperture in a corrugated paper tie sheet and then pass into and engage the superadjacent box.

* * * * *